United States Patent [19]

Gardner et al.

[11] 4,255,944

[45] Mar. 17, 1981

[54] SERVER FOR WINE BOTTLES AND THE LIKE

[75] Inventors: James H. Gardner; Noel H. de Nevers, both of Salt Lake City, Utah

[73] Assignee: Oros Company, Salt Lake City, Utah

[21] Appl. No.: 61,655

[22] Filed: Jul. 30, 1979

[51] Int. Cl.[3] ..... F25D 3/08

[52] U.S. Cl. ..... 62/457; 62/371

[58] Field of Search ..... 62/371, 372, 457, 529, 62/530

[56] References Cited

U.S. PATENT DOCUMENTS

| | | | |
|---|---|---|---|
| 1,858,728 | 5/1932 | Creighton | 62/457 X |
| 1,999,670 | 4/1935 | Strouse et al. | 62/372 |
| 2,838,916 | 6/1958 | Sola | 62/457 X |
| 3,205,678 | 9/1965 | Stoner | 62/457 |
| 3,282,068 | 11/1966 | Cain | 62/457 |
| 3,302,428 | 2/1967 | Stoner et al. | 62/457 |
| 3,360,957 | 1/1968 | Paquin | 62/457 |
| 3,743,130 | 7/1973 | Jorgensen | 62/372 |
| 3,995,445 | 12/1976 | Huskins | 62/371 |
| 4,037,428 | 7/1977 | Giannotti | 62/371 |

FOREIGN PATENT DOCUMENTS

| | | | |
|---|---|---|---|
| 72074 | 2/1893 | Fed. Rep. of Germany | 62/372 |

*Primary Examiner*—Lloyd L. King

*Attorney, Agent, or Firm*—Thorpe, North, Western & Gold

[57] ABSTRACT

A server for chilled wine and similar beverages or foods includes a generally cylindrically-shaped side wall into which a bottle or other container may be placed. The side wall is constructed of a heat conductive material such as aluminum, copper, alloys thereof, etc., of sufficient thickness to conduct heat as needed in its long direction. The cooler also includes an ice receptacle which holds the ice either in contact with the side wall or an extension or appendage thereof. The side wall acts to present the wine container with a surface which is at or below the temperature of the wine. This substantially eliminates the transfer of heat by radiation to the wine container. The server also minimizes conductive and/or convective heat transfer between the wine bottle and the surroundings.

5 Claims, 6 Drawing Figures

SERVER FOR WINE BOTTLES AND THE LIKE

BACKGROUND OF THE INVENTION

This invention relates to a server construction for efficiently and conveniently maintaining the temperature of chilled wine or other beverage or food in a container.

The conventional way to either chill wine or maintain the coldness of wine while the wine bottle sits on a table, counter, etc., is to place the wine bottle in an ice bucket filled with ice and water. Typically, a cloth napkin is also placed over the wine bottle. This method, although effective, is messy because the bottle and bottle label are made wet, become slippery, and may drip on the table or counter top when removed from the ice bucket. Also, the ice bucket is quite bulky and cumbersome to handle.

A number of proposals have been made for improving the above-described methods of serving chilled wine, and some of these are discussed in U.S. Pat. Nos. 2,564,165 and 2,068,384. These proposals, however, generally either are not very effective in maintaining wine in the chilled condition over desired extended periods, or have the same disadvantages as does the conventional wine cooler or ice bucket, or both. Chilling wine, of course, can easily be accomplished by placing the bottles in the refrigerator some hours before serving. What has been needed is a convenient, attractive, immediately effective, and mess-free arrangement for maintaining the wine at the table or bar at the refrigerator temperature over periods of time of up to two hours.

SUMMARY OF THE INVENTION

It is an object of the invention to provide a new and improved server for chilled wine bottles and similar beverage containers.

It is also an object of the invention to provide a server which will cool or maintain the low termperature of a beverage bottle without making the bottle wet.

It is a further object of the invention to provide a compact attractive server for beverage bottles.

The above and other objects are realized in a specific illustrative embodiment of a server which includes a housing open at the top for receiving a bottle to be cooled and having a side wall shaped to conform to and surround the side exterior of the bottle. The height of the side wall is at least about the same as the height of the enlarged portion of a typical beverage bottle so that when the bottle is placed in the housing, the side wall substantially surrounds the bottle. The side wall is made of a heat conductive material such as aluminum, copper, silver, etc., of sufficient thickness to conduct heat as needed in its long direction. The server also includes a receptacle for holding ice in contact either with the side wall or with heat conductive material which is joined to the side wall. The side wall is thus cooled by the ice in the receptacle to thereby present to the bottle a surface area at or below the desired serving temperature. Radiative heat transfer to the bottle is thus generally prevented, and the trapped air layer between the side wall and the bottle inhibits conductive or convective heat transfer to the bottle. In this manner, the bottle may be maintained at close to a refrigerator temperature for fairly long periods of time or, if the bottle is initially warmer than refrigerator temperatures, it can be slowly cooled.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Various embodiments of the present invention are shown in the accompanying drawings and will be described herein. The common features of the embodiments are the employment of a housing having a side wall for surrounding a bottle to be maintained cool or cooled, and the provision of an ice receptacle for holding ice either in contact with the side wall or with a heat conducting material which is connected to the side wall. Advantageously, the side wall is made of a thick piece of heat conducting material such as aluminum, copper, silver, etc., which facilitates conducting heat originating either from the bottle or from the surrounding environment to the ice to thereby cool the bottle or interfere and inhibit ambient heat from reaching the bottle. In this fashion, a bottle of wine or similar beverage may be effectively maintained at a cool temperature without the attendant mess associated with the conventional ice bucket.

Figure 1:
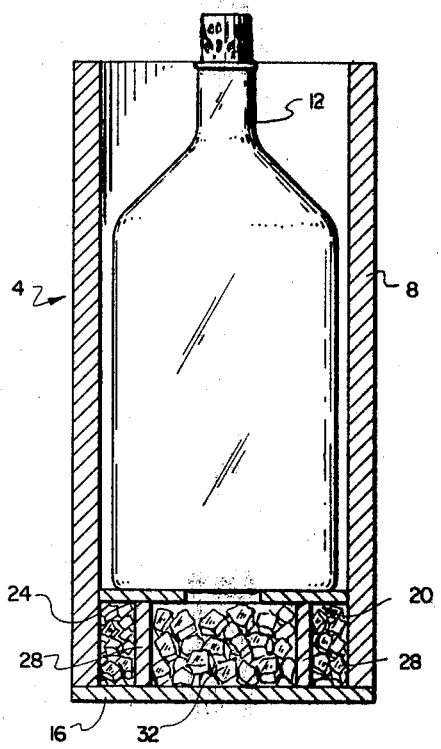
FIG. 1 shows a side, cross-sectional view of a server made in accordance with the principles of the present invention.

Referring now to FIG. 1, there is shown a side, cross-sectional view of a server housing 4 which includes a fairly thick-walled cylindrical shell 8 which is open at the top to allow placement therein of a bottle of wine 12 or similar beverage container. The housing 4 also includes a bottom wall 16 which is joined to the bottom of the cylinder 8 to form a water-tight container. The cylinder 8 and bottom wall 16 are made of a heat conducting material such as aluminum, copper, silver, etc., for purposes to be described hereinafter.

A support structure 20 is disposed at the bottom of the cylinder 8 to provide support for the bottle 12. This support structure could take a variety of forms including that of an annular disc 24 whose perimeter is joined to the interior surface of the cylinder 8 as shown in FIG. 1. The disc 24 could be further supported (or alternatively solely supported) by rod-like elements 28 extending from the bottom wall 16 upwardly to the bottom surface of the disc 24. Advantageously, the support structure 20 is also made of a heat conducting material.

In use, ice 32 is placed in the bottom of the housing 4 as shown and a bottle to be cooled or whose temperature is to be maintained cool is placed in the housing on the support structure 20. If the temperature of the bottle 12 is greater than that of the housing 4, then heat fom the bottle will radiate to the cylinder 8 and be conducted downwardly to the ice 32. Similarly, ambient heat will in large degree be intercepted by the cylinder 8 and likewise conducted downwardly to the ice 32.

Illustrative dimensions for the housing 4 of FIG. 1 are as follows:

| | |
|---|---|
| Outside diameter of cylinder 8: | 4 inches |
| Thickness of wall of cylinder 8: | .125 inches |
| Height of the housing 4: | 11 inches |
| Distance from support disc 24 to top of housing 4: | 7¾ inches |
| Distance between bottom wall 16 and support disc 24: | 3 inches |

For a server made in accordance with the present invention and having the above-defined dimensions, it has been found that for a bottle of wine which extends about 3¾ inches above the top of the housing 4 when placed in the housing and has an initial temperature of about 40 degrees Fahrenheit, the averge rise in temperature for the contents of the bottle is about 1 degree F. in the first hour and another degree F. in the second hour. This result was accomplished with an ambient room temperature of about 70 degrees F.

For best results, the height of the housing 4 should be sufficient so that the cylinder 8 substantially surrounds the bottle or at least the enlarged portion of a typical bottle (excluding the neck). Of course, the server still will inhibit the rise in temperature of a bottle of wine placed in the server even if the cylinder 8 leaves a portion of the bottle exposed above the top thereof.

Figure 2:
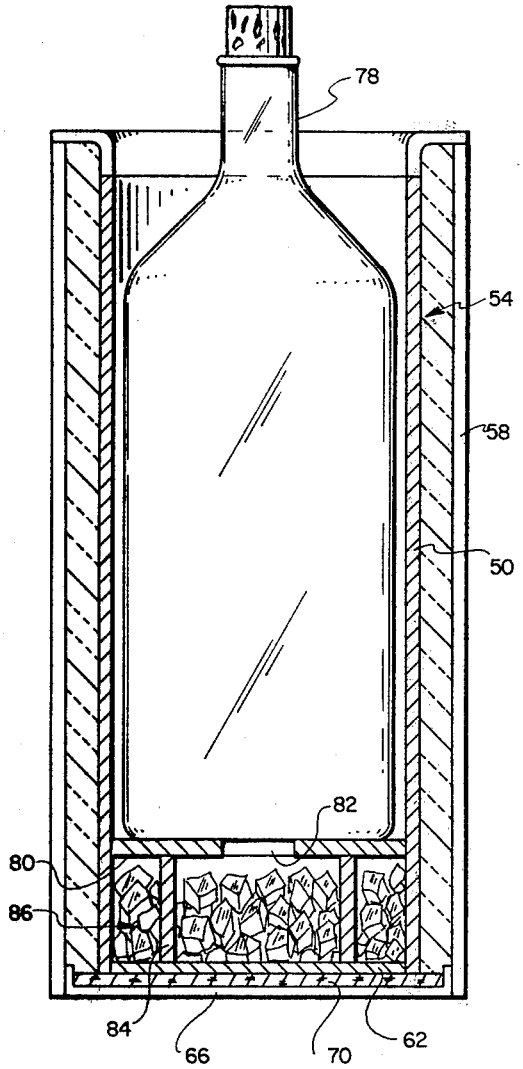
FIG. 2 is a side, cross-sectional view of another embodiment of the present invention which employs a jacket of insulation.

FIG. 2 is a side, cross-sectional view of another embodiment of the server of the present invention. This embodiment includes an inner, generally cylindrical side wall 50 made of a heat conducting material. A cylindrical shell of insulation material 54, such as polyurethane or polystryrene foam, is formed about the inner side wall 50. An outer cylindrical protective sleeve 58, made of a decorative material such as silver or stainless steel, is formed about the insulation material 54.

The inner cylinder 50 includes a bottom wall 62, constructed of a heat conducting material, and the outer sleeve 58 includes a bottom wall 66. Disposed between the inner bottom wall 62 and the outer bottom wall 66 is a layer of insulation material 70 such as cork or some sturdy foam material suitable for supporting the interior structure of the server and the wine bottle.

A support structure similar to that of FIG. 1 is disposed in the bottom of the inner cylinder 50, and includes having a table-top 80 with a central opening 82 formed therein, and legs 84 for supporting the table-top. Ice 86 is placed through the opening 82 below the table-top 80 to be in contact with the inner bottom wall 62 and inner side wall 50.

Provision of the insulation material 54 and 70 provides additional interference and inhibition to the transfer of ambient heat to the bottle 78 and thereby aids in maintaining the low temperature of the bottle.

Figure 3:
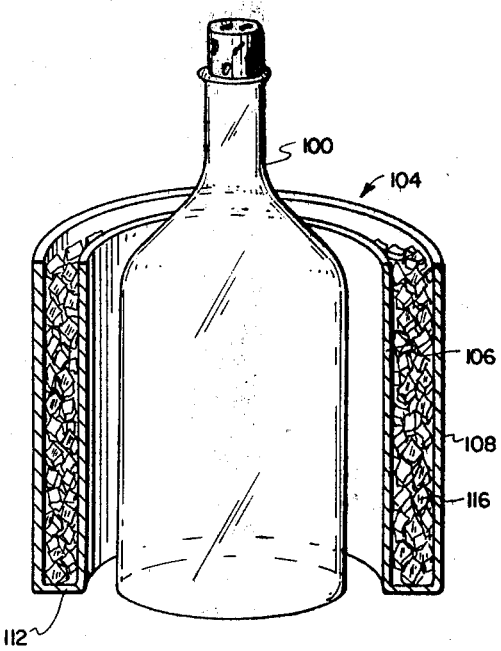
FIG. 3 is a sectioned view of still another embodiment of the present invention wherein the container to be cooled may be placed directly on the table or countertop.

FIG. 3 shows a sectioned view of a server in which a bottle 100 rests directly on the table or counter top within the cooler housing 104. The housing 104 includes an interior side wall 106 formed in a generally cylindrical shape to surround a bottle 104 placed within the side wall. The housing also includes an outer side wall 108 which circumscribes and is spaced from the inner side wall 106, and a bottom wall 112 which extends between the lower perimeters of the inner side wall 106 and the outer side wall 108 to form a cavity between the walls for holding ice 116.

The housing 104 of the server of FIG. 3 could be constructed of a heat conducting material, as in the previously described embodiments, or it could be constructed of glass to provide a more decorative server which would allow viewing the bottle through the housing or of stainless steel for durability. Glass would not conduct heat as readily as heat conducting material such as aluminum, copper, silver, etc., but when the ice 116 is placed in the cavity between the inner and outer side walls 100 and 108 to substantially fill the cavity, then the FIG. 3 server would substantially prevent heat loss from the bottle 104 and prevent ambient heat from transferring to the bottle.

Because the housing of FIG. 3 is open both at the top and the bottom so that the bottle may rest directly on the table or counter top, the height of the housing can be substantially reduced. This, of course, is because there is no need for a compartment below the bottle to hold the ice.

Figure 4:
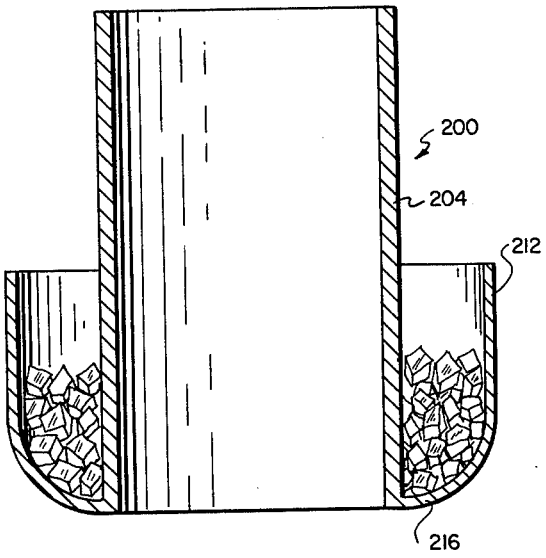
FIG. 4 is a side, sectioned view of an embodiment of the present invention in which the ice receptacle is located about the exterior of the primary server housing.

FIG. 4 is a side, sectioned view of a variation of the server shown in FIG. 3. Here, a housing 200 is formed in the shape of a hollow cylinder with a side wall 204 made of a heat conducting material. Formed to circumscribe the outside of the side wall 204 is an ice receptacle also having a side wall 212 and a bottom wall 216. The height of the side wall 212 of the ice receptacle is not as great as that of the side wall 204 and so ice in the receptacle is maintained in contact only with the lower portion of the side wall 204. However, since the side wall 204 is thick and made of a heat conductive material, heat from the bottle or surroundings is readily conducted to the ice in the receptacle.

Figure 5:
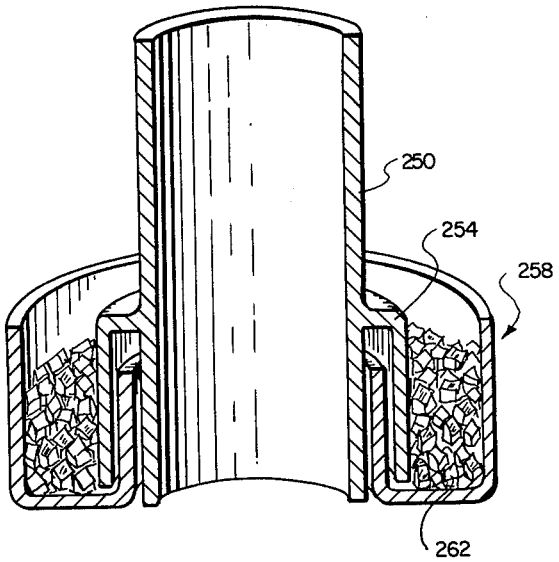
FIG. 5 is a side, cross-sectional view of a two-piece server made in accordance with the present invention.

FIG. 5 is a side, cross-sectional view of a two-piece server which includes a cylindrical shell 250 open at the top and bottom, and having an outwardly and downwardly extending flange 254. Again, the cylinder 250 is thick and is constructed of a heat conducting material. The other piece of the server is an annular trough 258 having a generally U-shaped cross-section as indicated in FIG. 5. The cylinder 250 and trough 258 are sized so that the cylinder may be placed within a central opening in the trough, with the flange 254 extending into the trough 258 to contact ice 262 placed in the trough. Heat intercepted by the cylinder 250 will be conducted downwardly through the flange 254 to the ice 262 to maintain at a low temperature a bottle placed in the cylinder.

Figure 6:
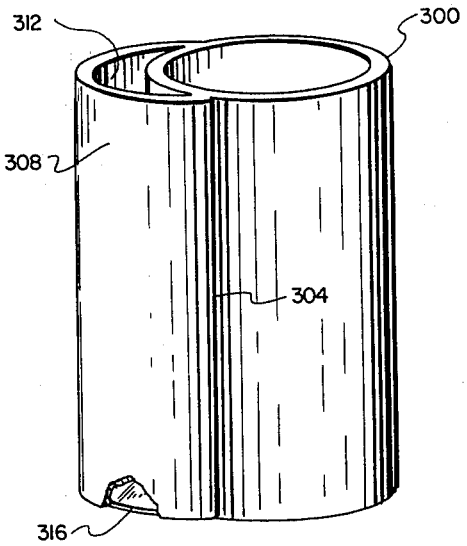
FIG. 6 is a perspective view of an additional embodiment of the server of the present invention.

FIG. 6 shows still another embodiment of a server which includes a cylindrical shell 300 open at the top for receiving a bottle of wine or other beverage. The shell 300 is constructed of a thick heat conducting material. Projecting outwardly from the exterior surface of the shell 300 along a generally vertical line 304 and curving about a portion of the side wall of the shell 300 to again join to the exterior surface of the shell is an outer wall 304. The outer wall 304, which in FIG. 6 is substantially the same height as the shell 300, defines a space 312 between the outer wall and the shell for receiving ice. A bottom wall 316 joins the bottoms of the outer wall 308 and a portion of the shell 300 to support and maintain ice in the space 312. The outer wall 308 can have a variety of shapes to hold ice into contact with a portion of the shell 300 to thereby cool the shell as previously described.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A server for wine bottles and the like comprising a housing open at the top for receiving a bottle and having side wall shaped to conform to and surround the side exterior of the bottle and a bottom wall joined at its perimeter to said side wall, said side wall having a height of at least substantially the same as the height of the enlarged portion of the bottle and being made of a heat conductive material, the side wall and bottom wall forming a receptacle means for holding ice in contact with said side wall to cause said side wall to absorb heat from the bottle if the bottle is at a higher temperature than the side wall, and to substantially prevent the transfer of ambient heat to the bottle, and support means within said housing above said bottom wall to hold the bottle above and out of contact with the ice, said support means having openings therein to allow placement of ice into the receptacle means through the top opening of the housing.

2. A server as in claim 1 wherein the side wall is about ⅛ of an inch or more in thickness.

3. A server as in claim 2 further comprising insulation material surrounding said side wall.

4. A server as in claim 3 further including an outer sleeve disposed about and covering said insulation material.

5. A server as in claim 1 wherein said side wall has a thickness of about 0.050 inches or greater.

* * * * *